United States Patent [19]

Atkinson

[11] 4,366,687

[45] Jan. 4, 1983

[54] CHANGEABLE COMBINATION LOCK FOR DESK DRAWERS AND THE LIKE

[75] Inventor: Wallace E. Atkinson, Petersburg, Va.

[73] Assignee: Long Manufacturing Co., Inc., Petersburg, Va.

[21] Appl. No.: 242,553

[22] Filed: Mar. 11, 1981

[51] Int. Cl.[3] ..... E05B 37/02; E05B 65/44; E05B 65/52

[52] U.S. Cl. ..... 70/71; 70/86; 70/81; 70/312; 70/316

[58] Field of Search ..... 70/69–76, 70/79–81, 85–86, 312, 315–318

[56] References Cited

U.S. PATENT DOCUMENTS 3,597,945 8/1971 Feinberg ..... 70/74

3,633,388 1/1972 Atkinson ..... 70/80

*Primary Examiner*—Robert L. Wolfe

*Attorney, Agent, or Firm*—Mason, Fenwick & Lawrence

[57] ABSTRACT

A combination lock and latching mechanism for desk drawers and similar receptacles, formed of a lock unit having plural, coaxial dial wheels and a stack of hubs therefor which are axially movable to decouple them from the dial wheels for changing the combination, together with a tiltable fence member and a vertically reciprocative locking bolt controlled thereby and by an operating lever accessible from in front of the lock, the lever also being operative to cause disengagement of the wheel hubs from their dial wheels in a predetermined condition of the lock for changing the lock combination.

8 Claims, 7 Drawing Figures

5
6
4
4
5
6
10
14
11
15
13
13a
14
16
12
20
37
11
23
10
13a
16
16a
16b
39
16b
42a
38
42
12
19
18b
40
18e
41
17
18d
34
34a
35
35c
35a
26
35b
22
23
27a
29
27
23
27
23
25
30
27
29
31
32
28
27a
33
33a
53b
51
46
17a
43
48
49a
49
47
50
53
53a
18
17
45
44
45
11
36a
36
37
24

CHANGEABLE COMBINATION LOCK FOR DESK DRAWERS AND THE LIKE

BACKGROUND AND OBJECTS OF THE INVENTION

The present invention relates in general to combination type latching devices adapted for application to receptacles or containers, such as sliding desk drawers and the like, to enable locking of the desk drawer or receptacle in closed position, and more particularly to locking mechanisms for desk drawers and the like having a plurality of rotatable combination dial members incorporated therein adapted to be individually set to a predetermined combination of dial numbers together with a fence member controlled locking bolt and a locking lever for moving the locking bolt between locking and unlocking positions and for conditioning the combination dial members to have their combinations changed.

Combination locks have been used for many years in a wide variety of locking applications, but such combination locks have predominately been of relatively complex and expensive construction, most commonly involving a plurality of peripherally gated tumbler wheels operated from a single dial. Such conventional combination locks, because of their size, expense of manufacture, and complex construction, have been frequently considered unsuitable for cost limited applications such as desk drawers and similar furniture drawers, luggage cases, and similar applications. In many of such drawer or sliding receptacle type applications, it is desirable to have a central locking mechanism disposed at a location substantially midway along the front panel or wall of the drawer, to control a vertically movable bolt member which may be extended into a stationary keeper recess or retracted from the keeper for locking and unlocking the drawer.

An object of the present invention is the provision of a novel combination lock mechanism for desk drawers, furniture drawers, and similar receptacle applications, wherein a simple combination lock mechanism of compact construction involving a plurality of combination dial members made up of directly positionable dial wheels and associated hub members which may be decoupled therefrom for changing the combination is provided, which is relatively simple in construction lending itself to less expensive manufacture, and which provides a novel structural arrangement and mechanism to achieve unlocking and combination change.

Another object of the present invention is the provision of a novel combination lock mechanism of the type described in the immediately preceding paragraph, to provide a significantly simplified type of combination lock mechanism suitable for less costly applications such as desk or furniture drawers, jewelry boxes, storage boxes for valuables, and similar applications, wherein a novel tiltable fence structure is associated with a movable bolt member and a control lever accessible from the front of the lock to control locking and unlocking of the bolt member and conditioning of the dial wheels in a combination change mode upon predetermined manipulation of the control lever.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figures 1, 2, 3:
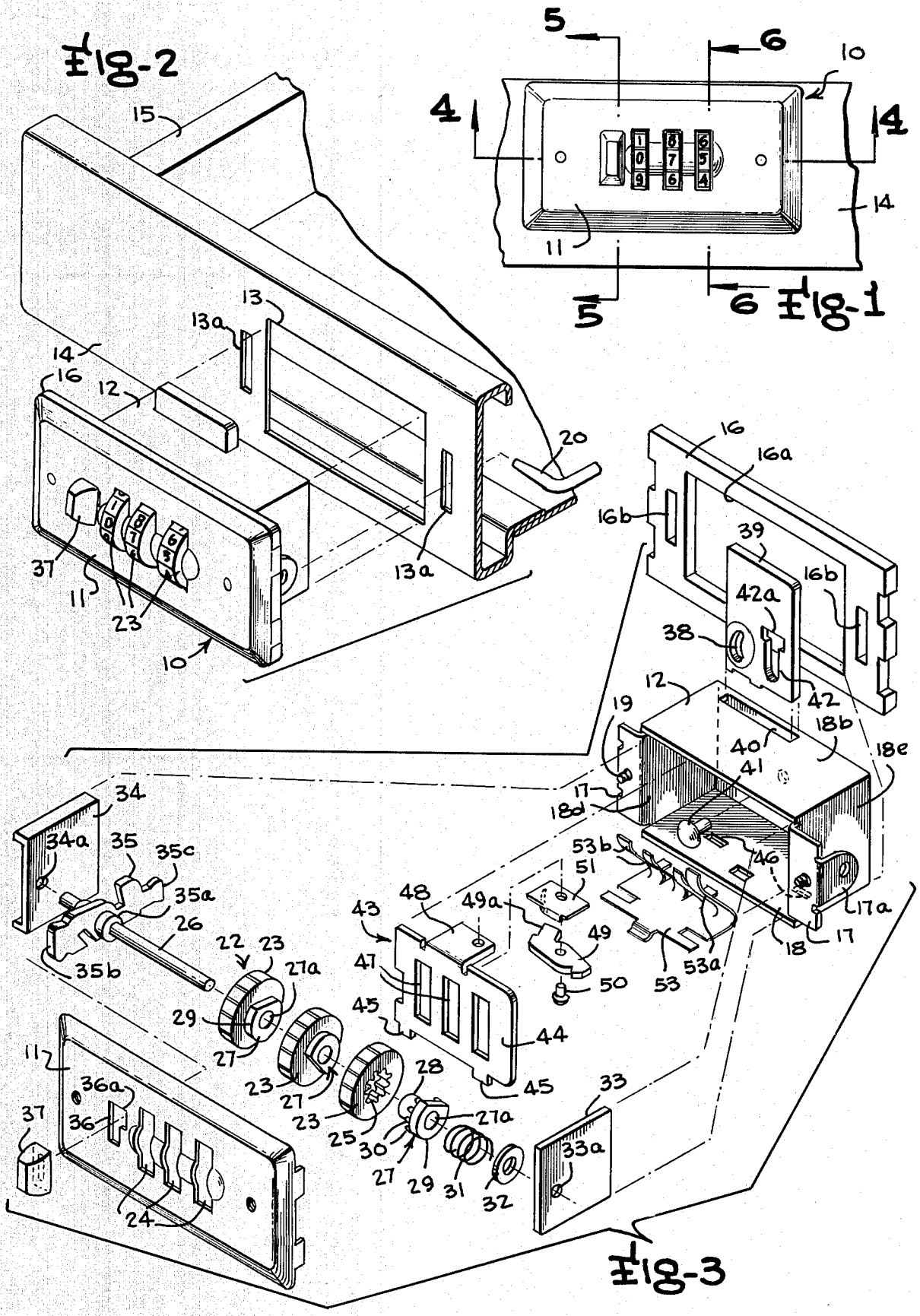
FIG. 1 is a fragmentary front elevation view of a desk drawer combination lock embodying the present invention, shown in position on a desk drawer front.
FIG. 2 is an exploded perspective view of the desk drawer combination lock and the adjacent portions of the associated desk drawer front in which it is designed to be mounted.
FIG. 3 is an exploded perspective view of the desk drawer combination lock mechanism.

Referring to the drawings, wherein like reference characters designate corresponding parts throughout the several figures, the desk drawer combination lock mechanism of the present invention is indicated generally by the reference character 10 and comprises a front face plate member 11 and a rearwardly projecting box-like housing 12 assembled therewith, adapted to extent through an opening 13 of suitable shape and size in the front wall 14 of the desk drawer 15. In the illustrated embodiment, the face plate member 11 is assembled with a backing frame 16 having an opening **16*a* of proper size and shape to receive the box-like housing 12 therethrough as well as slots 16*b* to receive the mounting ears 17*a* on the side flanges 17 at the front of the box-like housing 12, but this frame 16 could be incorporated integrally, if desired, in the face plate member 11 as a surround formation extending around the forwardmost edge portion of the walls of housing 12** rather than forming it as a separate member, if desired.

The box-like housing 12 includes a rear wall **18*a*, top and bottom walls 18*b* and 18*c* and end walls 18*d* and 18*e* from which the mounting flanges 17 extend. Mounting screws 19 extend forwardly through openings in the mounting flanges 17 and into tapped openings or sockets in the face plate member 11 to assemble the housing 12 to the face plate member. The rearwardly projecting mounting ears 17*a* of the flanges 17 extend through the slots 16*b* in the backing frame 16 and through similar slots 13*a* in the desk drawer front 14, and retaining members such as fastener pins, as indicated at 20, or equivalent holding devices such as rivets, set screws or the like are inserted through the holes in the mounting ears 17*a* adjacent and bearing against the rear surface of the desk front 14** to retain the lock assembled in the desk drawer front.

The combination mechanism to be manipulated to a particular combination of numbers for opening the lock is formed of a transversely aligned group or array of dial assemblies 22, aligned in side-by-side concentric relation along a horizontal axis paralleling the plane of the drawer front 14, three such dial assemblies 22 being provided in the illustrated embodiment. Each of the dial assemblies 22 comprises a dial wheel 23 in the form of a thin annular cylindrical member having dial marking lines and dial numerals on the periphery thereof, which project slightly through slots 24 in the front plate member 11 so as to be visible to the operator from the front of the desk drawer combination lock. Each dial wheel or disc 23 has an axial bore 25 extending therethrough provided with a plurality of concave notches in the inwardly facing surface thereof, ten such notches being present in the illustrated example. The dial assemblies 22 are journaled on the shaft 26 in coaxial relation along the common axis of the shaft by means of hubs 27, each of the same construction, associated with the respective dial wheels 23. Each of the hubs 27 has a center bore 27*a* through which the shaft 26 extends to support the hubs for rotational and axial sliding movement on the shaft, and includes a relatively smaller diameter, substantially cylindrical body portion 28 of a diameter corresponding to the minimum diameter of the bore 25 in the associated dial wheel 23 for relative rotation therein, and an adjoining larger diameter collar formation 29 of larger diameter than the minimum diameter of the bore 25 adapted to butt against the confronting face of the adjacent dial wheel 23. A plurality of eccentrically located, axially elongated interlocking pins or lugs 30, shown in the illustrated example as a diametrically opposed pair of lugs, projecte axially from the collar formation 29 along a portion of the axial length of the smaller diameter body portion 28 to be received in notches in the inwardly facing surface of the bore 25 of the associated dial wheel 23 and interlock the associated dial wheel 23 with its hub 27 against relative angular movement at any of the ten selected angular positions corresponding to the ten dial numbers on the periphery of the dial wheel 23.

Figure 4:
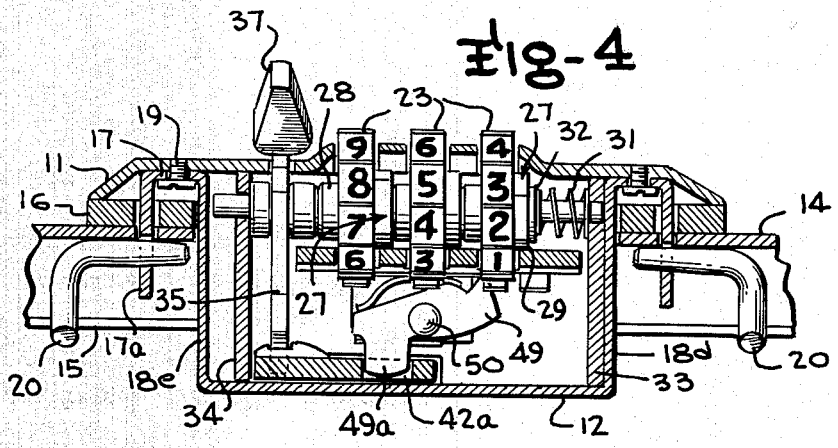
FIG. 4 is a horizontal section view of the desk drawer combination lock mechanism, taken along the line 4—4 of FIG. 1.

The stack of hubs 27 associated with the dial wheels 23 are in successive abutment with each other along the shaft 26 so as to be movable along the axis of the shaft 26 as a unit. The stack of hubs 27 is biased toward one end of the shaft 26, for example the left hand end as viewed in FIG. 4, by a coil spring 31 surrounding the shaft and compressed between the collar portion of the nearest hub 27 and a washer 32 surrounding the shaft 26 and abutting the mounting plate or block 33 apertured as indicated at 33*a* to journal the adjacent end of the shaft 26. The opposite end of the shaft 26 is journaled in a similar aperture 34*a* in the mounting plate or block 34 inwardly adjacent the opposite end wall 18*d* of the housing 12. The end of the body portion 28 of the hub 27 at the opposite end of the stack bears against a combination change and operating lever 35 journaled on the shaft 26, having a circular boss formation 35*a* of a diameter corresponding to the smaller diameter body portion 28 of the hubs 27 to bear against that body portion 28 of the nearest hub. The combination change and operating lever 35 normally occupies a position whereby the spring 31 on the shaft 26 biases the hubs 27 to the left as viewed in FIG. 4 seating the interlocking pins or lugs 30 in the recesses of the axial bores 25 of their associated dial wheels 23 so that the hubs and their associated dial wheels are held against relative angular movement at their appropriate angular positions for the particular lock combination.

Figure 5:
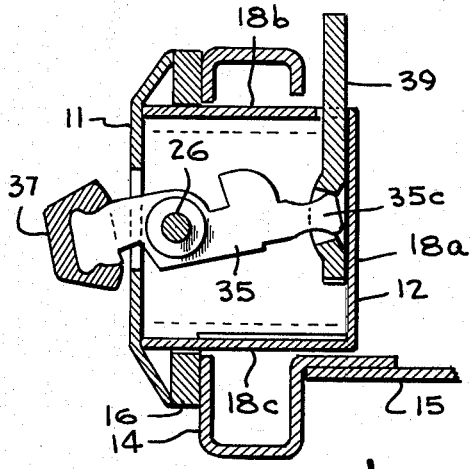

The combination change and operating lever 35 which is journaled to pivot about the axis of the shaft 26 includes a forwardly extending portion 35*b* which extends through the slot 36 in the front face plate 11 and, in the preferred embodiment illustrated herein, has a plastic knob or shaped fingerpiece 37, for example of slightly resilient plastic material, tightly fitted on the front end portion 35*b* of the lever 35. The portion of the lever 35 extending rearwardly from the axis of the shaft 26 terminates in a reduced rear toe formation 35*c* which is loosely fitted in a slot 38 in the bolt member 39 which is located forwardly against the rear wall 18*a* of the box-like housing 12 for reciprocative vertical movement through the slot 40 in the top wall 18*b* of the housing 12 between an upwardly projected locking position, shown in FIGS. 5 and 6, and a retracted unlocking position shown in FIGS. 2 and 7. The bolt member 39 is guided in its vertical axis of movement by a rivet 41 fixed in the rear wall 18*a* of the housing and extending through a vertically elongated slot 42 of generally T-shaped configuration having a horizontally enlarged crosshead 42*a* at the top of the slot 42.

Figure 6:
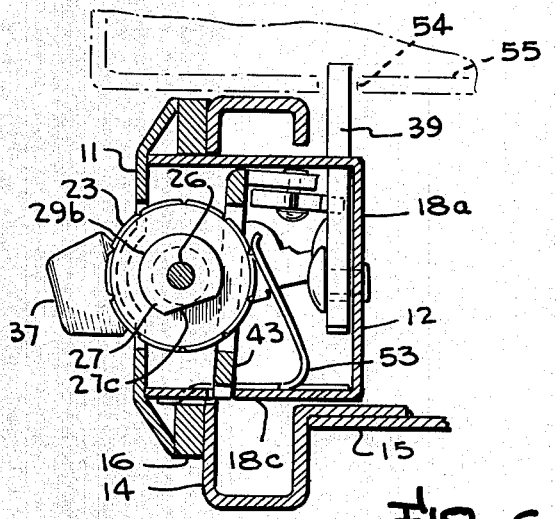
FIGS. 5 and 6 are vertical section views through the desk drawer combination lock mechanism, taken along lines 5—5 and 6—6 respectively of FIG. 1 with the lock in locking condition.
Figure 7:
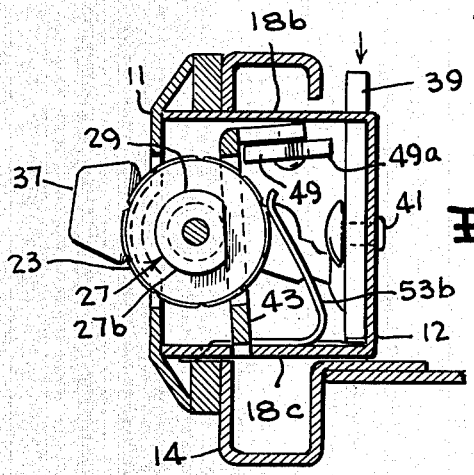
FIG. 7 is a vertical section view similar to FIG. 6, but showing the desk drawer combination lock in unlocked condition.

The bolt 39 is controlled by a pivotally mounted fence 43 located rearwardly adjacent the stack of dial wheel assemblies 22 and formed of a generally vertically extending, substantially rectangular plate portion 44 having short downwardly projecting lugs or tabs 45 at its lower edge loosely fitted into slots 46 in the bottom wall 18*c* of the housing 12 to form the pivot axes for the fence along its lower edge, and having vertically elongated rectangular openings 47 rearwardly aligned with and shaped to receive the rearmost about one-third of each dial wheel 23 therethrough, as is evident from FIGS. 6 and 7. A rearwardly projecting integral ear 48 extends from the upper edge of the fence 43 in its midregion and provides pivotal support for a locking lever 49 pivoted on the rivet 50 to the ear 48 and biased normally to the locking position shown in FIG. 4 by the spring member 51. The locking tongue 49*a* of the locking lever 49 is positioned to project into the horizontally enlarged top cross-portion 42*a* of the slot 42 in bolt 39 when the bolt is in its upper locking position shown in FIGS. 5 and 6, and while the fence is in its rearward locking position shown in FIG. 6 held against displacement forwardly toward the shaft 26 by the cylindrical portions 29*b* of the hub collars 29. However, when the proper combination has been dialed, the flats 29*c* on the hub collar portions 29 all assume a rearwardly facing position shown in FIG. 7 permitting the portions of the fence 44 laterally flanking the openings 47 to bear against the flats 29*c* and allow the fence to swing toward the shaft 26 to the unlocking position illustrated in FIG. 7. The fence 43 is biased toward the front of the lock to continuously bear against the peripheries of the collar portions 29 of the hubs 27, whether it be the full diameter cylindrical portions 29*b* or the flats 29*c* thereof, by a spring-finger 53*a* of spring 53, which also has three additional spring-fingers 53*b* having convexly curved end portions bearing against the peripheries of the three dial wheels 23 and forming detents for the dial wheels coacting with the indented dial marking lines between successive dial numerals on the dial peripheries.

In the normal operation of the lock, assuming the lock to be in locked condition with the bolt 39 projecting upwardly into the keeper recess therefor, such as indicated at 54 in FIG. 6, in the upper desk wall portion 55 forming the upper boundary for the drawer recess for drawer 15, the operator manually adjust the angular positions of the dial assemblies 22 in accordance with the combination number to which the lock is set. When the proper numbers on the three dial wheels 23 for the lock combination are aligned, for example with the horizontal plane through the shaft 26, this disposes the flats 29c on the perpheries of the collar portion 29 of the dial assembly hubs 27 in rearwardly facing relation shown in FIG. 7 to accommodate forward tilting movement of the fence 43 to the unlocking position of FIG. 7, withdrawing the locking tongue 49a of locking lever 49 from the slot portion 42a in the bolt 39. Upward movement of the knob 37 on the forward end of the operating lever 35 moving it from the FIG. 6 position to the FIG. 7 position causes the rearmost end portion 35c of the lever to move downwardly, drawing the bolt 39 downwardly to the retracted unlocking position. To relock the lock, the operator normally merely shifts the operating lever knob 37 downwardly to the FIG. 6 position and rotates the dial wheels 23 away from the proper combination position, thereby raising the locking bolt 39 to the locking position, and moving the fence 43 to its rearward locking position engaging the cylindrical portions of the hub collars, and projecting the nose 49a of the locking lever into the slot portion 42a of the bolt, holding the bolt 39 in the raised and locked position. The spring biased pivoted locking lever 49 also enables the operator to upset the combination by rotating the dial wheels 23 while the bolt 39 is still in the lowered, unlocked position of FIG. 7, since the locking lever portion 49a simply butts against the front face of the bolt 39 and pivots about the rivet 50 against the bias of the spring 51, until the lever knob 37 is pushed downwardly, pivoting the lever 35 to raise the bolt 39 to the projected locking position whereupon the locking lever portion 49a snaps into the slot portion 42a when the slot portion 42a comes into registry with the locking lever portion 49a.

To change the combination, the lock must be moved to the unlocked condition by setting the dial wheels 23 to the proper combination and raising the front end portion of the lever 35 to the FIG. 7 position, which is the unlocking position of the lever. The lever 35 is then pressed to the right into the portion 36a of the slot 36, which presses the hubs 27 of the dial assemblies 22 to the right to a decoupled position so that the dial wheels 23 are free to turn relative to the hubs 27. The dials are then turned to the new combination desired, and the lever 35 returned to the left to its normal position, whereupon the spring 31 shifts the hubs 27 back to coupled position with their associated dial wheels 23 and the lock is now set on the new combination. The lock is then returned to the locked condition in the normal manner.

I claim:

1. A combination lock for receptacles such as desk drawers and the like, comprising a lock case having a vertical rear wall and a front face plate secured to the lock case, a horizontal shaft journaled in said case adjacent and parallel to said front face plate, a set of plural rotatable combination dial wheel assemblies disposed in axially spaced coaxial relation along said shaft, said wheel assemblies each comprising an outer annular dial wheel and an inner hub extending therethrough selectively intercoupled at plural relative angular position with respect to said dial wheel, a movable fence rearwardly adjacent said dial assemblies having a locking projection extending rearwardly therefrom and locking and unlocking positions, means on said hubs coactive with said fence for restraining the latter at said locking position and releasing the fence to unlocking position, said hubs being slidably and rotatably journaled on said shaft in endwise abutting stacked relation, means at one end of the stack of hubs biasing them to a first axial position interlocking them against angular displacement relative to their respective dial wheels, means for releasing the hubs from their dial wheels at a second axial position of the hubs, a change and operating lever having a portion abutting the other end of said stack, means journalling said change lever on said shaft for angular movement about the shaft axis over an arcuate range between upper and lower vertically spaced angular positions, a slidable bolt member guided for vertical movement adjacent said rear wall between a projected position and a retracted position, the bolt member having a first slot receiving a rearward end portion of said change and operating lever therein for movement of the bolt member by the lever between said projected and retracted positions and having a second slot for receiving the locking projection of said fence therein only at the projected position of said bolt member to lock the latter at said projected position when the fence occupies its locking position, said front face plate having dial wheel openings therein through which portions of the dial wheels project forwardly for exposing portions thereof to observation and hand manipulation and having a shaped vertically extending guide slot through which a front portion of the change and operating lever extends accommodating lever movement its said vertically spaced angular positions disposing the bolt member at its projected and retracted positions and said guide slot having a lateral extension at one end thereof accommodating a limited extent of lateral angular movement of the lever about its end portion in said first slot to shift the lever axially along said shaft to force said hubs from said first axial position to said second axial position.

2. A combination lock as defined in claim 1, wherein said wheel assemblies each comprise an outer annular dial wheel and an inner hub extending therethrough selectively intercoupled at plural relative angular positions with respect to said dial wheel, said dial wheels being spaced axially from each other defining intervening spaces therebetween, said hubs having fence controlling portions in said intervening spaces defining a circumferential cylindrical surface interrupted by a flat gating formation, the fence being supported adjacent the dial wheels spanning the whole group of dial wheel assemblies for angular movement about a pivot axis paralleling the axis of said shaft at the lower edge of the fence, said fence having contact portions extending into said intervening spaces into engagement with said fence controlling portions of said hubs to be positioned at a locking position by said cylindrical surfaces and at an unlocking position when abutting said gating formations.

3. A combination lock as defined in claim 1, including means intercoupling said hubs with their respective dial wheels in any of a plurality of relative angular positions at a first relative axial position of the latter and releasing the hubs for relative angular movement at a second relative axial position, resilient means continuously biasing the stack of hubs to said first relative axial position, and said change and operating lever being loosely journaled for angular movement in both vertical and horizontal directions on said shaft bearing against an end of the stack of hubs and shiftable horizontally along said shaft axis to first and second axially displaced positions to dispose said stack at said first axial position at the first axially displaced position of the lever, and the horizontal movement of the lower portion bearing against the end of the stack of hubs being sufficient to shift the stack to said second axial position when said lever occupies said second axially displaced position.

4. A combination lock as defined in claim 2, including means intercoupling said hubs with their respective dial wheels in any of a plurality of relative angular positions at a first relative axial position of the latter and releasing the hubs for relative angular movement at a second relative axial position, resilient means continuously biasing the stack of hubs to said first relative axial position, and said change and operating lever being loosely journaled for angular movement in both vertical and horizontal directions on said shaft bearing against an end of the stack of hubs and shiftable horizontally along said shaft axis to first and second axially displaced positions to dispose said stack at said first axial position at the first axially displaced position of the lever, and the horizontal movement of the lower portion bearing against the end of the stack of hubs being sufficient to shift the stack to said second axial position when said lever occupies said second axially displaced position.

5. A combination lock as defined in claim 1, wherein said locking projection of said fence is a latch lever pivoted about a vertical axis and spring biased to urge a latch end thereof toward said bolt member into said second slot, the latch lever being pivotable against its spring bias to a displaced position engaging its said latch end with bolt member portions displaced from said second slot when the lever is moved from its unlocking to locking positions to thereby accommodate movement of the dial wheels to settings different from the opening combination while the bolt is still in retracted position and effect spring movement of the latch end of the latch lever into said second slot when the bolt member is returned to projected position.

6. A combination lock as defined in claim 2, wherein said locking projection of said fence is a latch lever pivoted about a vertical axis and spring biased to urge a latch end thereof toward said bolt member into said second slot, the latch lever being pivotable against its spring bias to a displaced position engaging its said latch end with bolt member portions displaced from said second slot when the lever is moved from its unlocking to locking positions to thereby accommodate movement of the dial wheels to settings different from the opening combination while the bolt is still in retracted position and effect spring movement of the latch end of the latch lever into said second slot when the bolt member is returned to projected position.

7. A combination lock as defined in claim 3, wherein said locking projection of said fence is a latch lever pivoted about a vertical axis and spring biased to urge a latch end thereof toward said bolt member into said second slot, the latch lever being pivotable against its spring bias to a displaced position engaging its said latch end with bolt member portions displaced from said second slot when the lever is moved from its unlocking to locking positions to thereby accommodate movement of the dial wheels to settings different from the opening combination while the bolt is still in retracted position and effect spring movement of the latch end of the latch lever into said second slot when the bolt member is returned to projected position.

8. A combination lock as defined in claim 4, wherein said locking projection of said fence is a latch lever pivoted about a vertical axis and spring biased to urge a latch end thereof toward said bolt member into said second slot, the latch lever being pivotable against its spring bias to a displaced position engaging its said latch end with bolt member portions displaced from said second slot when the lever is moved from its unlocking to locking positions to thereby accommodate movement of the dial wheels to settings different from the opening combination while the bolt is still in retracted position and effect spring movement of the latch end of the latch lever into said second slot when the bolt member is returned to projected position.

* * * * *